US007670474B2

(12) United States Patent
Koyama et al.

(10) Patent No.: US 7,670,474 B2
(45) Date of Patent: Mar. 2, 2010

(54) METHOD OF REDUCING/REGENERATING OIL OR PREVENTING OXIDIZATION/DEGENERATION THEREOF

(75) Inventors: Saburo Koyama, Ichihara (JP); Fumiaki Takagi, Ichihara (JP); Toshio Fuchigami, Yokohama (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 409 days.

(21) Appl. No.: 10/547,674

(22) PCT Filed: Mar. 5, 2004

(86) PCT No.: PCT/JP2004/002823

§ 371 (c)(1),
(2), (4) Date: Aug. 25, 2006

(87) PCT Pub. No.: WO2004/078894

PCT Pub. Date: Sep. 16, 2004

(65) Prior Publication Data

US 2007/0158206 A1 Jul. 12, 2007

(30) Foreign Application Priority Data

Mar. 5, 2003 (JP) ..... 2003-058011

(51) Int. Cl.
*C07C 51/36* (2006.01)

(52) U.S. Cl. ..... 205/695; 205/696

(58) Field of Classification Search ..... 205/695, 205/696, 763, 765
See application file for complete search history.

(56) References Cited

U.S. PATENT DOCUMENTS 4,388,162 A * 6/1983 Sammells et al. ..... 205/638
4,439,311 A 3/1984 O'Blasny
5,951,839 A * 9/1999 Reznik ..... 204/554
6,300,292 B2 * 10/2001 Konishi et al. ..... 508/371
6,326,336 B1 * 12/2001 Gatto et al. ..... 508/290
6,335,310 B1 * 1/2002 Suekuni et al. ..... 508/409
6,825,367 B2 * 11/2004 Lalvani et al. ..... 554/147

FOREIGN PATENT DOCUMENTS

JP 58-120698 7/1983

(Continued)

OTHER PUBLICATIONS

Minoru Fujita , et al. ed., Tripology Library 2, Practical Performance of Lubricant, (Japan, Saiwai Shobo Corporation, Jun. 10, 1981, First Edition pp. 56-60), partial English translation.
Hiroshi Horiguchi, Lubricant ad Grease, (Japan, Sankyo Publishing Co., Ltd, Apr. 25, 1968, pp. 387-394), partial English translation.

*Primary Examiner*—Arun S Phasge
(74) *Attorney, Agent, or Firm*—Oblon, Spivak, McClelland, Maier & Neustadt, L.L.P.

(57) ABSTRACT

A method of reduction reclamation of an oil or prevention of oxidation degradation of the oil of the present invention includes: using an electrolytic cell 13 having an anode 11 and a cathode 12 made of a hydrogen storage material, and inside of the cell divided by the cathode 12 into an electrolytic chamber 13A and a reduction chamber 12A; supplying the oil to the reduction chamber 12A while applying an electric voltage between the anode 11 and the cathode 12 to electrolyze an electrolytic solution supplied to the electrolytic chamber 13 (Translator's comment: correctly, 13A); and absorbing hydrogen generated on the cathode 12 in the electrolytic chamber 13A in the cathode 12 to reduce the oil in the reduction chamber 12A, the method for reduction reclamation of the oil or prevention of oxidation degradation of the oil allowing continuous treatment.

23 Claims, 1 Drawing Sheet

FOREIGN PATENT DOCUMENTS

| | | |
|---|---|---|
| JP | 64-036694 | 2/1989 |
| JP | 07-237901 | 9/1995 |
| JP | 9-184086 | 7/1997 |
| JP | 10-088182 | 4/1998 |
| JP | 10-195686 | 7/1998 |
| JP | 2002-114992 | 4/2002 |

* cited by examiner

METHOD OF REDUCING/REGENERATING OIL OR PREVENTING OXIDIZATION/DEGENERATION THEREOF

TECHNICAL FIELD

The present invention relates to a method of reduction reclamation of an oil or prevention of oxidation degradation of the oil.

BACKGROUND ART

Conventionally, a waste oil generated when using edible oil, lubricating oil, etc., have been generally treated by combustion, and it has not been very common to recycle the waste oil. On the other hand, it is pointed out that there is a possibility to produce dioxin by combusting substances contained in the waste oil and the like, and thus there exists the present situation that combustion of the waste oil cannot be conducted without careful consideration. Accordingly, recycling methods in place of the combustion have been discussed, and there have been proposed methods for removing contaminants from the waste oil, for example, by filtration, adsorption or semi-permeable membrane.

However, even with these methods, the waste oil cannot always be turned to a reusable condition. From another aspect, since the waste oil usually contains substances which are oxidized such as edible oil and the like, a method for performing reduction treatment of the waste oil to reclaim the oil with a condition before use has been thought to be effective. Thus recently, the reduction treatment of the waste oil has particularly attracted attention and has been continuously studied.

As a specific example of the reduction treatment for the waste oil, there has been proposed a method where a strongly alkaline reducing water prepared by electrolyzing a water containing salt is added to the waste oil and the like to reduce the waste oil to a natural glycerin through chemical reaction (Japanese Patent Laid-open Application Publication 2002-114992).

However, in the aforementioned technology, since the salt solution is immixed, the reducing water must be separated from the reclaimed waste oil again, so that the waste oil cannot be treated continuously.

On the other hand, in order to inhibit oxidation degradation of oil, an antioxidant is generally added. However, it is known that, as the oil is used, the function of the antioxidant is lowered and is lost at the end.

Further, in order to maintain the function of the antioxidant added to the oil, the additional antioxidant must be added, but since the amount to be added is limited, a method for maintaining the function of the antioxidant has been desired.

DISCLOSURE OF THE INVENTION

An object of the present invention is to provide a method of reduction reclamation of an oil or prevention of oxidation degradation of the oil, which allows continuous treatment and allows a function of an antioxidant to be maintained.

A method of reduction reclamation of an oil or prevention of oxidation degradation of the oil according to an aspect of the present invention for reducing and reclaiming an oxidized and degraded oil includes the steps of: using an electrolytic cell having an anode and a cathode made of a hydrogen storage material, inside of the electrolytic cell being divided by the cathode into an electrolytic chamber and a reduction chamber; supplying the oil to the reduction chamber while applying an electric voltage between the anode and the cathode to electrolyze an electrolytic solution supplied to the electrolytic chamber; and absorbing in the cathode hydrogen generated on the cathode in the electrolytic chamber to reduce the oil in the reduction chamber.

Herein, examples of the oil may include mineral oil, turbine oil, hydraulic oil, metalworking oil, engine oil and lubricating oil obtained either in use or after use.

As the antioxidant, quinone system, phenol system, amine system and the like may be used.

As the anode, there may be exemplified as platinum, carbon, nickel, and stainless steel.

As the hydrogen storage material of the cathode, there may be exemplified palladium, a palladium alloy such as palladium-silver alloy, a rare-earth metal alloy such as lanthanum-nickel alloy, a misch metal-nickel alloy, a titanium alloy and a zirconium alloy.

The electrolytic solution with which the electrolytic cell is filled is not particularly limited as long as the solution generates hydrogen from the cathode at the time of the electrolysis. For instance, aqueous potassium hydroxide solution, aqueous sodium hydroxide solution and the like can be exemplified as basic electrolytic solution. Also, aqueous sulfuric acid solution, aqueous hydrochloric acid solution and the like can be exemplified as an acidic electrolytic solution.

Reactions generated in the electrolytic solution during the electrolysis will be described below.

A reaction formula in a case of a basic electrolytic solution such as aqueous potassium hydroxide solution or aqueous sodium hydroxide solution or a neutral electrolytic solution is as follows:

$$H_2O+e^- \rightarrow Had+OH^- \quad \text{(I)}$$

A reaction formula in a case of an acidic electrolytic solution such as aqueous sulfuric acid solution, aqueous hydrochloric acid solution or the like is as follows:

$$H^++e^- \rightarrow Had \quad \text{(II)}$$

In Formulae (I), (II), Had is an adsorbed hydrogen, and the reaction as according to the above Formula (I), (II) occurs on the outer surface of the cathode which is in contact with the electrolytic solution. The Had in Formulae (I) and (II) is held on the outer surface of the cathode in an adsorbed state. The adsorbed hydrogen is converted to a state absorbed in the cathode as shown in Formula (III) below.

$$Had \rightarrow Hab \quad \text{(III)}$$

In Formula (III), Hab is an absorbed hydrogen and the Hab in Formula (III) described above is reacted with the supplied oil to reduce the oil.

Further, the hydrogen absorbed in the cathode is consumed only when the cathode contacts with the oil so that the reduction of the oil occurs. A consumed amount of hydrogen is produced as the electrolysis proceeds and absorbed in the cathode, and thereby the cathode constantly absorbs hydrogen in an amount close to the maximum absorption amount.

According to the present invention, a continuous reduction treatment of the oil can be carried out by supplying the oil to the reduction chamber while conducting the electrolysis, because the hydrogen to be required for the reduction is generated continuously by the electrolysis.

Further, by the reduction of the oil, since the oxidation degradation of the oil itself is inhibited, a load to the antioxidant to inhibit oxidation degradation can be lightened. As a result, the function of the antioxidant can be maintained longer than in the conventional arrangement, and further, the degraded antioxidant itself can also be reduced, thus recovering the function.

In the method of reduction reclamation of an oil or prevention of oxidation degradation of the oil according to the present invention, it is preferable that the cathode is formed by a tubular member penetrating the electrolytic cell; and an inner space of the tubular member defines the reduction chamber.

Herein, the cathode may be any member of tubular form, which may have a polygonal cross section such as triangle, quadrangle or pentagon or may have a circular or elliptic cross section.

In addition, for smooth proceeding of the reduction reaction in the reduction chamber of the cathode, it is preferable that a contact area between the reduction chamber and the oil is sufficiently large, and therefore desirably the surface of the contact portion is sufficiently roughened.

In order to roughen the inner surface of the tube of the cathode, blasting treatment or etching treatment is desirable. Although a degree of treatment is not particularly limited, the blast treatment is preferably carried out by using an alumina grid having around 15 to 20 meshes, whereby substantial surface area becomes 2-3 times.

Moreover, in order to improve a reaction efficiency of the reduction reaction in the cathode, a palladium black is formed on the inner surface of the tube of the cathode by electrolytic reduction treatment of palladium chloride. This palladium black acts as a catalyst during the reduction reaction to improve the reaction efficiency.

With the arrangement, by defining the reduction chamber by the inner space of the tubular member, the supplied oil is surrounded with the tubular member of the cathode, and the contact area between the inner surface of the tubular member and the oil is increased, and the oil reacts with the hydrogen absorbed in the cathode effectively, which results in enhancing the efficiency of the reduction reaction.

In addition, in supplying the oil to the reduction chamber, supplying amount is controlled as appropriate in accordance with state of the reduction.

In the method of reduction reclamation of the oil or prevention of oxidation degradation of the oil according to the present invention, it is preferable that the electric voltage applied between the anode and the cathode is 0.1 to 100 V.

When the electric voltage is less than 0.1 V, since an amount of the generated hydrogen becomes small, which possibly provides a case where the amount of the hydrogen is insufficient for reducing the oil continuously.

On the other hand, when the electric voltage exceeds 100 V, since an electric power to produce hydrogen of more than a limit amount required for the reduction is consumed, the electric power might be unnecessarily consumed.

In the method of reduction reclamation of the oil or prevention of oxidation degradation of the oil according to the present invention, it is preferable that the electrolytic solution is an aqueous sulfuric acid solution of 0.01 to 10 N.

When the concentration of the aqueous sulfuric acid solution is less than 0.01 N, the efficiency of the electrolysis is low, and thus the amount of the generated hydrogen becomes small, which possibly provides a case where the amount of the hydrogen is insufficient for reducing the oil continuously.

On the other hand, when the concentration of the aqueous sulfuric acid solution exceeds 10 N, since sulfuric acid that produces hydrogen of more than a limit amount required for the reduction is consumed, material cost might be increased.

In the method of reduction reclamation of the oil or prevention of oxidation degradation of the oil according to the present invention, it is preferable that the cathode is palladium or a palladium alloy.

With the arrangement, since the palladium or palladium alloy has an extremely high hydrogen permeability, and has a catalytic activity for the reduction reaction, it is suitable for a material of the cathode.

BEST MODE FOR CARRYING OUT THE INVENTION

Figure 1:
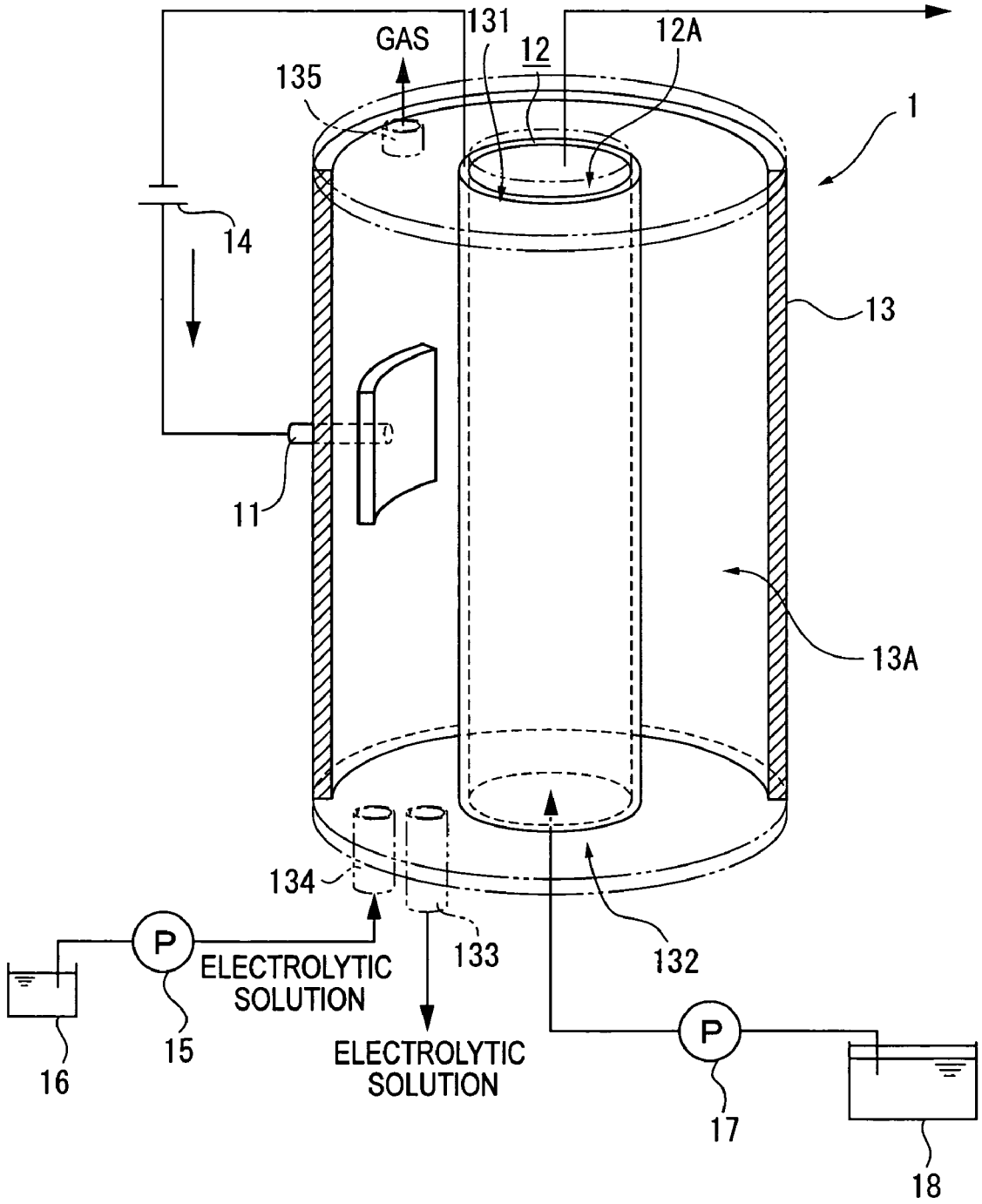
FIG. 1 is a schematic view of a reduction device according to an embodiment of the present invention.

An embodiment of the present invention will be described with reference to the attached drawing.

FIG. 1 shows a reduction device 1 for an oil according to an embodiment of the present invention.

The reduction device 1 is a device for reducing and reclaiming an oxidized and degraded oil, which includes a cylindrical electrolytic cell 13 having an anode 11 and a cathode 12 made of a hydrogen storage material, an electric power source 14 for applying electric voltage to the anode 11 and the cathode 12, an electrolytic solution pump 15 for supplying the electrolytic solution into the electrolytic cell 13, an electrolytic solution reservoir 16, an oil pump 17, and an oil reservoir 18.

Herein, examples of the oil may include a mineral oil, turbine oil, hydraulic oil, metalworking oil, engine oil and lubricating oil obtained either in use or after use.

The anode 11 is a rectangular plate member made of platinum and is provided on an inner wall of the electrolytic cell 13 at central portion in the depth direction.

The cathode 12 divides inside portion of the electrolytic cell 13 into an electrolytic chamber 13A and a reduction chamber 12A each described later, the cathode 12 being formed by a tubular member made of palladium which penetrates the cylindrical electrolytic cell 13 along a central axis thereof, and the inside space of the tubular member defines the reduction chamber 12A.

A palladium black prepared by electrolytic reduction treatment of palladium chloride is formed on a tubular surface of the cathode 12.

Further, blast treatment is provided to the tubular inner surface of the tube of the cathode 12. As the surface-roughening, blast treatment, etching treatment and the like can be exemplified. Also, smaller thickness of the tube of the cathode 12 can provide higher reduction efficiency.

The electrolytic cell 13 is a cylindrical member with upper and lower sides thereof being closed with platy members, and a space excluding the cathode 12 in the electrolytic cell 13 defines the electrolytic chamber 13A. A discharge port 131 and a supply port 132 each corresponding to the inner diameter of the cathode 12 are provided at the centers of the platy members of the upper and lower sides for supplying and draining the oil.

A discharge port 133 and a supply port 134 for supplying and draining the electrolytic solution are provided at a radially-outer part from the center of the platy member on the lower side of the electrolytic cell 13.

A gas exhaust port 135 for exhausting a gas generated from the electrolytic solution in the electrolytic cell 13 upon the electrolysis is provided at a radially-outer part from the center of the platy member on the upper side of the electrolytic cell 13.

The discharge port 131, the supply port 132, the discharge port 133, the supply port 134 and the gas exhaust port 135 can be arbitrarily opened and closed by valves or the like, although not shown in the figure.

The electrolytic cell 13 is filled with the electrolytic solution. This electrolytic solution is aqueous sulfuric acid solution of 0.01 to 10 N (normal).

When the concentration of the aqueous sulfuric acid solution is less than 0.01 N, an efficiency of the electrolysis is low, and thus the amount of the generated hydrogen becomes small, which possibly provides a case where the amount of the hydrogen is insufficient for reducing the oil continuously.

On the other hand, when the concentration of the aqueous sulfuric acid solution exceeds 10 N, since sulfuric acid that produces hydrogen of more than a limit amount required for the reduction is consumed, there is a case where material cost might be increased.

The electric power source 14 is a variable voltage power source. A positive electrode of the electric power source 14 is connected to the anode 11, and a negative electrode of the electric power source 14 is connected to the cathode 12.

The electrolytic solution pump 15 is provided for supplying the electrolytic solution stored in the electrolytic solution reservoir 16 to the electrolytic cell 13 via the supply port 134. Although not shown, a valve or the like may be provided between the electrolytic solution pump 15 and the supply port 134.

The oil pump 17 is provided for supplying the oil stored in the oil reservoir 18 to the cathode 12 via the supply port 132. Although not shown, a valve or the like may be provided between the oil pump 17 and the supply port 132 for controlling feed rate of the oil.

A reduction method using the reduction device 1 will be described below.

First, the electrolytic solution stored in the electrolytic solution reservoir 16 is supplied into the electrolytic chamber 13A of the electrolytic cell 13 via the supply port 134 by actuating the electrolytic solution pump 15. After checking that the electrolytic chamber 13A is filled with the electrolytic solution, the electric power source 14 is actuated to apply electric voltage between the anode 11 and the cathode 12.

At this time, the electric voltage applied between the anode 11 and the cathode 12 is preferably 0.1 to 100 V.

Electrolysis starts in the electrolytic solution, and since the electrolytic solution is the aqueous sulfuric acid solution which is acidic, reactions described below occur on contact surfaces of the anode 11 and cathode 12 contacting with the electrolytic solution. A reaction represented by Formula (IV) below occurs on the anode 11.

$$2H_2O \rightarrow O_2 + 4H^+ + 4e^- \quad \text{(IV)}$$

Also, the reaction represented by Formula (V) below occurs on the cathode 12.

$$H^+ + e^- Had \quad \text{(V)}$$

In Formula (V), Had is an adsorbed hydrogen. The Had in Formula (V) is kept in the adsorbed state on the outer surface of the cathode 12. The adsorbed hydrogen is converted to be of the state absorbed in a tubular wall of the cathode 12 as shown in Formula (VI) described below.

$$Had \rightarrow Hab \quad \text{(VI)}$$

In Formula (VI), the Hab is an absorbed hydrogen.

After power distribution from the power source 14 starts and electrolysis starts in the electrolytic solution, the oil stored in the oil reservoir 18 is supplied to an inside portion of the cathode 12, namely the reduction chamber 12A via the supply port 132 by actuating the oil pump 17.

At this time, the feed rate of the oil is controlled by regulating the oil pump 17.

This feed rate of oil is appropriately controlled in accordance with state of the reduction. When the feed rate is too small, the amount of oil to be continuously reduced becomes too small, which is not practical in some cases. On the other hand, when a feed rate is too large, since the oil is drained from the cathode 12 before the oil contacts with the reduction chamber 12A of the cathode 12 to be reduced, an amount of the oil that is not reduced sufficiently is possibly increased.

The hydrogen absorbed in the cathode 12 (Hab in Formula (VI)) reaches the reduction chamber 12A of the cathode 12, and reacts with the oil supplied to the reduction chamber 12A to reduce the oil.

Besides, during the electrolysis, $O_2$ and $H_2$ gases are generated in the electrolytic cell 13 as shown in above Formulae (IV), (V). Therefore, the gas exhaust port 135 is appropriately opened and closed to exhaust the gases of $O_2$ and an excess $H_2$ that have not been absorbed.

According to the aforementioned embodiment of the present invention, the following advantages are obtained.

(1) Since the oil is supplied to the reduction chamber 12A of the cathode 12 while conducting the electrolysis, the hydrogen to be required for the reduction is generated continuously by the electrolysis, which allows continuous reduction treatment of the oil. Also, due to the reduction of the oil, since the oxidation degradation of the oil itself is inhibited, when the antioxidant is added to the oil, a load to the antioxidant to inhibit the oxidation degradation can be lightened. As a result, the function of the antioxidant can be maintained longer than in conventional arrangements, and the degraded antioxidant itself can also be reduced, which recovers its function.

(2) When the reduction chamber 12A is defined by the inner space of the tubular member forming the cathode 12, the supplied oil is surrounded with the tubular member of the cathode 12, and the contact area between the inner surface of the tubular member and the oil is increased, and the oil reacts with the hydrogen absorbed in the cathode 12 effectively, thereby enhancing the efficiency of the reduction reaction.

(3) Since palladium has an extremely high hydrogen permeability and has a catalytic activity with respect to the reduction reaction, it is suitable as a material of the cathode 12.

(4) By forming the palladium black on the inner surface of the tube of the cathode by electrolytic reduction treatment of palladium chloride, the palladium black acts as a catalyst during the reduction reaction, thereby enhancing the reaction efficiency.

(5) Since the surface roughening treatment is provided on the inner surface of the tube of the cathode 12, the substantial surface area is increased and reactivity in the reduction reaction of the oil can be enhanced.

The present invention is not limited to the aforementioned embodiment, and any variations and improvements are included in the present invention so far as the object of the present invention can be achieved.

Although platinum is used as the anode 11 in the aforementioned embodiment, carbon, nickel, stainless steel or the like may also be used.

Although the tubular member having the circular cross section is used as the cathode 12 in the aforementioned embodiment, the cathode 12 may have a polygonal cross section such as triangle, quadrangle and pentagon, or may have elliptic cross section.

Although the cathode 12 is made of palladium in the aforementioned embodiment, the cathode 12 may be made of palladium alloy such as palladium-silver alloy, rare-earth metal alloy such as lanthanum-nickel alloy, misch meta-nickel alloy, a titanium alloy or a zirconium alloy.

Specific configurations and profiles when implementing the present invention may be other configurations or the like as long as the object of the present invention can be attained.

The present invention will be described more specifically with reference to an example and a comparison. Incidentally, the present invention is not limited to the contents of the example, etc.

EXAMPLE

An oil was reduced using the reduction device 1 of the aforementioned embodiment. The conditions thereof were as follows:

Anode 11: Square platy member of 1.7 cm×1.7 cm

Inner diameter of cathode 12: 3 mm

Outer diameter of cathode 12: 5 mm

Length of cathode 12: 200 mm

Electrolytic solution: aqueous sulfuric acid solution, concentration 30 g/l

Value of electric current: 30 mA

Feed rate of oil: 450 ml/hour

A composition used was 99 wt % of a mineral oil (150 Neutral Oil) and 0.5 wt % of an antioxidant (4,4'-DIHYDROXY-3,3',5,5'-TETRA-TERT-BUTYLBIPHENYL).

First, the above composition was introduced into the oil reservoir 18 (under the condition of: contaminated with copper powder and iron powder, 720 hours, 100° C.) to be oxidized and degraded, and while the composition was oxidized and degraded in the oil reservoir 18, the composition was supplied continuously to the reduction device 1 to carry out the reduction treatment. The treated oil was returned to the oil reservoir 18 and was recycled.

[Comparison]

The above composition was oxidized and degraded in the oil reservoir 18 under the condition same as that of Example, but the reduction treatment was not carried out.

[Evaluation Method]

The oil obtained in the above Example and Comparison was evaluated based on a life test (Rotary Bomb Oxidation Test (RBOT) in JIS-K-2514). The evaluation results are shown in the following Table 1. Incidentally, the life test was conducted for the composition before treatment of oxidation degradation.

TABLE 1

| | RBOT value (minute) |
|---|---|
| Before oxidation degradation test | 179 |
| Example | 170 |
| Comparison | 90 |

According to Table 1, it is found out that the condition before oxidation degradation is maintained in the Example, while the life is about a half as compared to the condition before oxidation degradation in the Comparison. Accordingly, it is found out that, by providing the reduction treatment using the reduction device that conducts the reduction method of the present invention, the condition before use can be maintained.

INDUSTRIAL APPLICABILITY

The present invention can be used advantageously as a method of reduction reclamation of an oil or prevention of oxidation degradation of the oil, which allows continuous treatment of, for example, waste oils such as mineral oil, turbine oil, hydraulic oil, metalworking oil, engine oil and lubricating oil, and allows a function of antioxidants to be maintained.

The invention claimed is:

1. A method of reductively reclaiming oxidized and degraded oil, the oxidized and degraded oil comprising at least one antioxidant selected from the group consisting of phenolic antioxidants and quinone antioxidants, the method comprising:

supplying the oxidized and degraded oxidized oil to a reduction chamber of an electrolytic cell comprising an anode and a cathode comprising a hydrogen storage material, an inside of the electrolytic cell being divided by the cathode into an electrolytic chamber and the reduction chamber;

applying an electric voltage between the anode and the cathode to electrolyze an electrolytic solution supplied to the electrolytic chamber; and contacting hydrogen generated in the electrolytic chamber by the cathode with the oxidized and degraded oil to reduce the oil and degraded antioxidant present therein in the reduction chamber.

2. The method according to claim 1, wherein: the cathode is formed by a tubular member penetrating the electrolytic cell; and an inner space of the tubular member defines the reduction chamber.

3. The method according to claim 2, wherein: the electric voltage applied between the anode and the cathode is 0.1 to 100 V.

4. The method according to claim 2, wherein: the electrolytic solution is an aqueous sulfuric acid solution of 0.01 to 10 N.

5. The method according to claim 2, wherein: the cathode comprises palladium or a palladium alloy.

6. The method according to claim 1, wherein: the electric voltage applied between the anode and the cathode is 0.1 to 100 V.

7. The method according to claim 6, wherein: the electrolytic solution is an aqueous sulfuric acid solution of 0.01 to 10 N.

8. The method according to claim 6, wherein: the cathode comprises palladium or a palladium alloy.

9. The method according to claim 1, wherein: the electrolytic solution is an aqueous sulfuric acid solution of 0.01 to 10 N.

10. The method according to claim 9, wherein: the cathode comprises palladium or a palladium alloy.

11. The method according to claim 1, wherein: the cathode comprises palladium or a palladium alloy.

12. The method of claim 1, wherein the oil is selected from the group consisting of mineral oil, turbine oil, hydraulic oil, metalworking oil, and lubricating oil.

13. The method of claim 1, wherein the anode comprises platinum, carbon, nickel, or stainless steel.

14. The method of claim 1, wherein the electrolytic solution is basic.

15. The method of claim 14, wherein the electrolytic solution is selected from the group consisting of aqueous potassium hydroxide and aqueous sodium hydroxide.

16. The method of claim 1, wherein the electrolytic solution is acidic.

17. The method of claim 16, wherein the electrolytic solution is selected from the group consisting of aqueous sulfuric acid and aqueous hydrochloric acid.

18. The method according to claim 1, wherein the oil is an edible oil.

19. The method according to claim 1, wherein the oil is mineral oil.

20. The method according to claim 1, wherein the oil is lubricating oil.

21. The method according to claim 1, wherein the electrolytic solution supplied to the electrolytic chamber is 0.01-10N aqueous sulfuric acid.

22. The method according to claim 1, wherein the oxidized and degraded oil comprises at least one phenolic antioxidant.

23. The method according to claim 1, wherein the oxidized and degraded oil comprises at least one quinone antioxidant.

* * * * *